US005541620A

United States Patent [19]

Reynolds

[11] Patent Number: 5,541,620

[45] Date of Patent: Jul. 30, 1996

[54] CRT CURSOR CONTROL SYSTEM

[75] Inventor: David C. Reynolds, Georgetown, Mass.

[73] Assignee: Analog Devices, Inc., Norwood, Mass.

[21] Appl. No.: 413,188

[22] Filed: Mar. 30, 1995

Related U.S. Application Data

[63] Continuation of Ser. No. 158,637, Nov. 29, 1993, abandoned.

[51] Int. Cl.[6] ..... G09G 5/08

[52] U.S. Cl. ..... 345/145; 345/157

[58] Field of Search ..... 345/145, 156, 345/157, 159

[56] References Cited

U.S. PATENT DOCUMENTS 4,868,548 9/1989 Gelvin ..... 345/145

5,196,837 3/1993 Shoji et al. ..... 345/145

*Primary Examiner*—Richard Huerpe

*Assistant Examiner*—Kent Chang

*Attorney, Agent, or Firm*—Parmelee, Bollinger & Bramblett

[57] ABSTRACT

A cursor control system where the starting x-axis pixel position of the cursor pattern is determined by decoding the last two bits of the preloaded x-axis address (as determined by a manual control manipulated by the operator). This decoded data produces a signal for controlling the transmission gate multiplexer so as to determine the position where the cursor data stream is inserted into the video data stream.

4 Claims, 2 Drawing Sheets

CRT CURSOR CONTROL SYSTEM

This application is a continuation of application Ser. No. 08,158,637 as originally filed on Nov. 29, 1993 is now abandoned.

BACKGROUND OF THE INVENTION

1. Field of the Invention

This invention relates to apparatus and methods for producing a cursor on a CRT to identify the location of a particular part of a video display. More particularly, this invention relates to techniques for synchronizing cursor signals controlled by a relatively low speed clock with video data clocked at a higher speed.

2. Description of the Prior Art

Video display systems frequently incorporate a so-called RAMDAC to generate the analog signals for controlling the color guns of a CRT. Internally, the RAMDAC operates at a high pixel clock rate such as 135 MHz, and sometimes as high as 360 MHz. U.S. Pat. 4,864,548 shows a system where a cursor generating circuit operating at a relatively low clock rate is synchronized with a RAMDAC operating at a higher clock rate. That system however is quite complex and has problems. One particular problem with that system is that it requires the development of an underflow or carry signal from a multi-bit incremented down-counter to produce a control signal for selecting the pixel location where the cursor pattern is to start.

SUMMARY OF THE INVENTION

In a preferred embodiment of the invention, described hereinbelow in detail, the starting x-axis pixel position of the cursor pattern is determined by decoding the last two bits of the preloaded x-axis address (as determined by a manual control manipulated by the operator). This decoded data produces a signal for controlling the transmission gate multiplexer so as to determine the position where the cursor data stream is inserted into the video data stream. Other objects, aspects and advantages of the invention will be pointed out in, or apparent from, the following description of preferred embodiments of the invention, considered together with the accompanying drawings.

DETAILED DESCRIPTION OF THE PREFERRED EMBODIMENT

Figure 1:
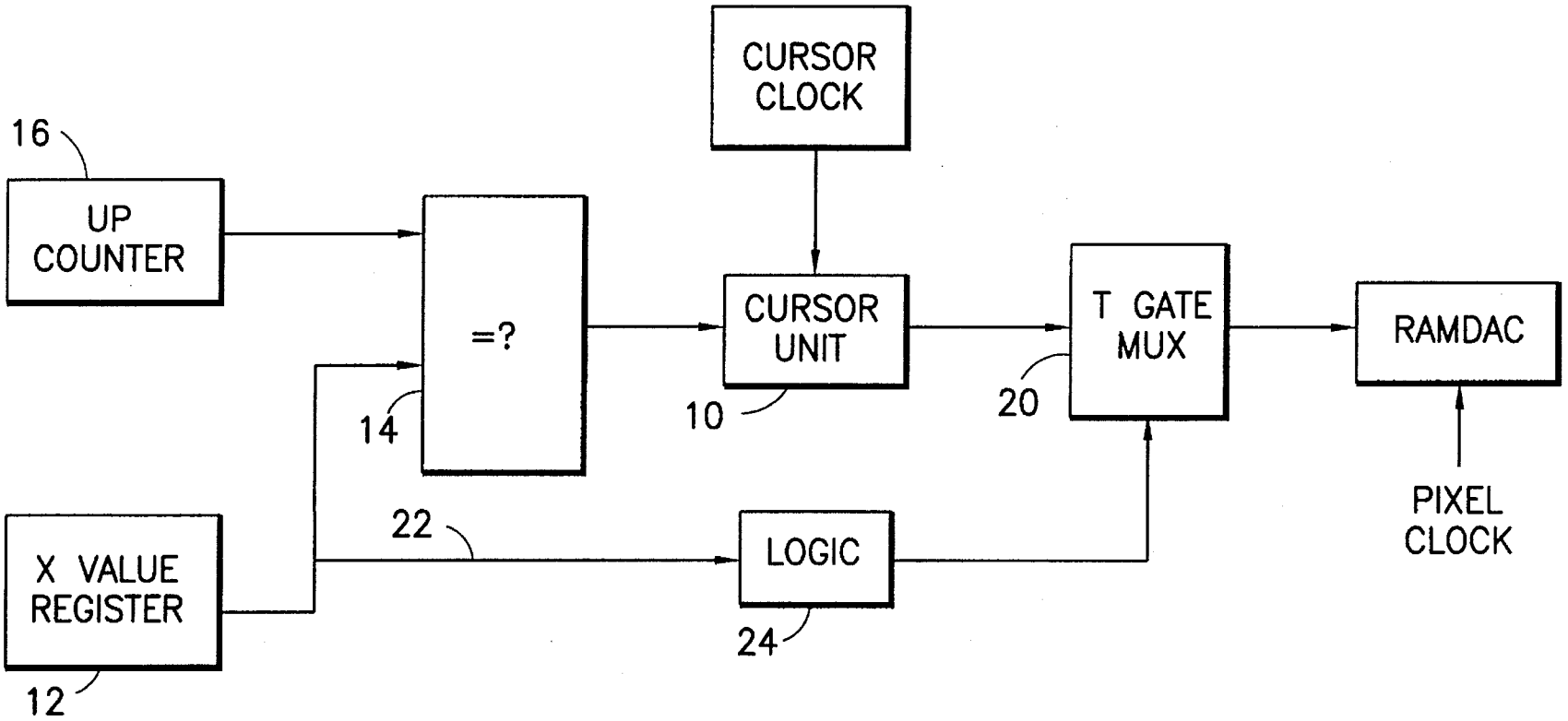
FIG. 1 is a block diagram showing one embodiment of the invention.

Referring now to FIG. 1, there is shown in block diagram format basic elements of a cursor controller for use with RAMDAC apparatus (not shown in detail) supplying video pixel signals to a CRT, either black/white or color. The RAMDAC and the video circuitry for the CRT operate at a high clock rate such as 135 to 360 MHz, whereas the cursor controller operates at a lower clock rate, e.g., one-fourth the video clock rate. The blocks of FIG. 1 represent conventional devices known in the art such as described in U.S. Pat. No. 4,868,548 and elsewhere. The novelty in the present invention resides primarily in the manner in which the devices are deployed in the cursor controller system.

The cursor image being controlled might typically be 64 pixels wide and 64 pixels high, for a CRT screen of 1600×1280 pixels. The cursor configuration is defined by data bits stored in a memory in the cursor unit 10. The data for each pixel may be two bits, one to control whether the DAC data passes through to the RAMDAC, and the other to select a color index.

The starting position for the cursor image (i.e., the location of the pixel in the upper left-hand corner of the cursor image) is inserted by the operator. The x-axis position (address) of the requested location is placed in an x-value register 12. That is, the register will contain a binary number identifying the number of pixels between the beginning of the horizontal line on the CRT and the start position for the upper left-hand corner of the cursor image.

The number in this x-value register 12 is directed as one input to a comparator 14 having a second input from an up-counter 16. The up-counter starts at zero at the beginning of each horizontal CRT line, and is clocked by the cursor controller clock to increment the count by a predetermined number of bits for each clock pulse. The number of bits for each increment is determined by the ratio (always an integer) between the video clock rate and the cursor clock rate. For the 4:1 ratio mentioned above, the counter will increment 4 bits at each clock pulse, representing 4 pixel positions on the CRT.

The comparator 14 produces an output signal when the up-counter number comes within 3-bits of the pre-loaded x-value in the register 12 (for the case where the counter is incremented 4-bits at a time). This output signal activates the cursor unit 10 to cause it to start feeding the cursor image overlay data into a transmission gate multiplexer 20 the output of which goes to the RAMDAC apparatus controlling the CRT (as in the above '848 patent).

Since the up-counter increments by four (in the example described), the number it produces for match detection by the comparator 14 may be identical to the x-value, or it may be a number less than the x-value by one, two or three bits. Thus, when the comparator activates the cursor unit 10, the image data it produces at the instant of activation may or may not be exactly in correct time to insert the first cursor pixel (upper left hand corner of the image) into the x-axis location specified by the x-value register 12.

To assure correct timing to produce this result, the flow of pixel signals from the cursor unit 10 is acted on by the transmission gate multiplexer 20. This multiplexer is basically a shift register providing a number of selectable segments (4, in the example given), offset respectively by one pixel position. This multiplexer may for example be like that described in the above-mentioned '548 patent (as shown in patent FIG. 6 and referred to as the "offset mux"). That multiplexer is controlled by underflow signals $Q_0$, $Q_1$, $Q_2$ from a down-counter 20 (see FIG. 4 of the patent).

In the present invention, however, transmission gate multiplexer 20 is controlled in a different way. More particularly, in the disclosed embodiment the two least significant bits from the x-value register 12 determine the offset for the start point for the cursor image. These two bits are directed by a lead 22 to a logic device 24 which decodes the two-bit binary number and produces a corresponding control signal for the transmission gate multiplexer 20. This control signal selects one of the multiplexer segments corresponding to the decoding of the two least significant bits. The output of the selected segment fixes the time of the initial cursor pixel such that it enters the video RAMDAC at the point in the stream of video data corresponding to the x-axis address specified by the number in the x-value register 12. Thereafter, the remainder of the cursor image data for that CRT scan line is transferred to the RAMDAC, four pixels at a time, at the cursor clock rate, to provide synchronization with the 4-times faster video clock rate.

The system also includes y-axis controls (not shown) which sequence the cursor unit 10 to transfer out successive sets of pixel data for the corresponding successive horizontal lines across the CRT. This sequencing operation can be carried out as has been done in the prior art.

Figure 2:
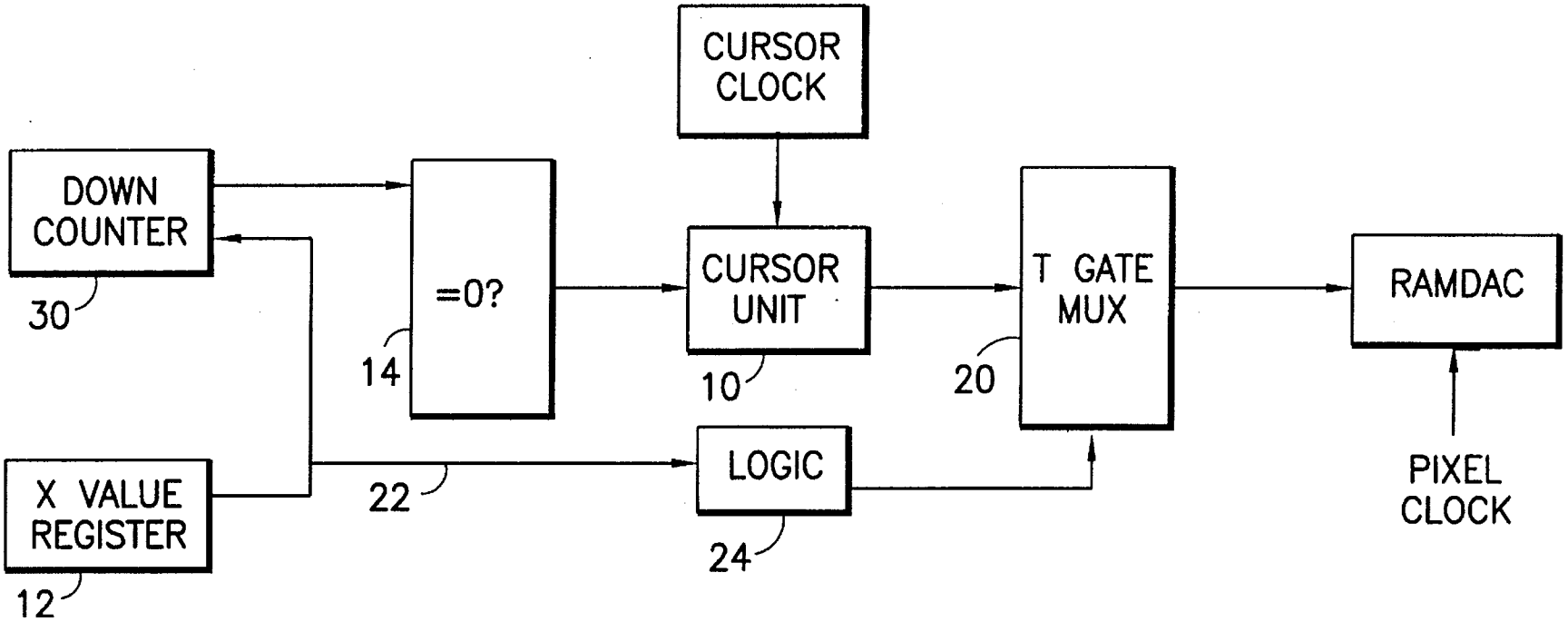
FIG. 2 is a block diagram showing a modified embodiment of the invention.

FIG. 2 shows a modified cursor control system. In this embodiment, the transmission gate multiplexer 20 is, as before, controlled by decoded signals from the two least significant bits stored in the x-value register 12. However, in this case, the comparator 14 receives the output of a down-counter 30 which is initially loaded with the address in the x-value register. This down-counter is incremented (4 bits at a time in the example described above), until the down counter output reaches zero (or beyond zero), at which point the comparator produces a control signal to activate the cursor unit 10. The system otherwise operates in the same manner as that shown in FIG. 1.

Although specific preferred embodiments of the invention have been disclosed herein in detail, it is to be understood that this is for the purpose of illustrating the invention, and should not be construed as necessarily limiting the scope of the invention since it is apparent that many changes can be made by those skilled in the art while still practicing the invention claimed herein.

What is claimed is:

1. In an operator-controlled CRT display system having RAMDAC means responsive to digital pixel signals to develop analog signals for controlling the CRT beam intensity, and wherein the system includes cursor means under control of the operator for developing overlay pixel signals to produce on the CRT screen a cursor image for indicating the location of a particular part of the display; said cursor means being operable by a clock running at a rate less than the clock rate for the CRT pixel signals; said cursor means comprising:

memory means storing cursor pixel data signals for developing a cursor image on the CRT screen;

a comparator;

means including an x-value register having an output supplying an operator-adjustable binary x-value input number to said comparator to select the cursor position on the CRT screen;

an up-counter supplying binary numbers to said comparator in synchronism with the progression of the CRT beam across the screen;

said comparator being operable to produce an output signal when the binary input numbers from said x-value register and said up-counter reach a pre-determined state;

means to direct said comparator output signal to said memory means to activate said memory means when said binary input numbers from said x-value register and said up-counter reach said pre-determined state, thereby to read out a set of said cursor pixel data signals;

transmission gate multiplexer means coupled to said memory means to receive said set of cursor pixel data signals, said multiplexer providing a number of selectable segments; and control means including logic means coupled to said x-value register output, said logic means serving to decode at least one least significant bit of the number in said x-value register output to select, during a time period while the CRT beam is sweeping across the screen, a particular multiplexer segment of said transmission gate to provide that the corresponding pixel data signals be directed from said multiplexer means to said RAMDAC means in time so as to position said cursor image in the CRT screen position selected by the operator.

2. Apparatus as in claim 1, wherein said up-counter is arranged to start counting from zero when a horizontal CRT screen line is started; and said comparator is arranged to produce said output signal when the up-counter number equals the x-axis address.

3. Apparatus as in claim 2, wherein said control means is arranged to decode the two least significant bits of the x-value number.

4. The method of controlling the positioning of a cursor image in a CRT display system having RAMDAC means responsive to digital pixel signals to develop analog signals for controlling the CRT beam intensity, and wherein the system includes cursor means for developing signals to produce on the CRT screen a cursor image for indicating the location of a particular part of the display under control of the operator; said cursor means being operable by a clock running at a rate less than the clock rate for the CRT pixel signals; said method comprising the steps of:

storing cursor pixel data signals in memory means;

storing in a register a binary number representing the desired x-axis position of the cursor;

supplying to a comparator sequential binary numbers representing x-axis addresses;

utilizing said comparator to produce an output signal when the binary numbers supplied to said comparator reach a pre-set number condition corresponding to the desired position of said cursor;

while the CRT beam is sweeping across the CRT screen, directing said comparator output signal to said memory means to activate said memory means when said binary numbers reach said pre-set number condition, thereby to read out a set of said cursor pixel data signals;

supplying said read-out cursor pixel data signals to transmission gate multiplexer means providing a number of selectable multiplex segments offset from one another by one pixel;

while the CRT beam is sweeping across the screen, utilizing logic means to decode at least one least significant bit of said binary number stored in said register to produce a corresponding control signal; and directing said control signal to said transmission gate multiplexer to select a particular multiplexer segment of said transmission gate multiplexer to be directed to said RAMDAC means so as to position said cursor image in the position selected by the operator.

* * * * *